US006997023B1

(12) United States Patent
Huang

(10) Patent No.: US 6,997,023 B1
(45) Date of Patent: Feb. 14, 2006

(54) COMBINED COMBINATION LOCK AND PADLOCK

(75) Inventor: Chien-Chien Huang, Changhua (TW)

(73) Assignee: Glox Industry Co., Ltd., Changhua (TW)

( * ) Notice: Subject to any disclaimer, the term of this patent is extended or adjusted under 35 U.S.C. 154(b) by 0 days.

(21) Appl. No.: 11/174,869

(22) Filed: Jul. 5, 2005

(30) Foreign Application Priority Data

Oct. 20, 2004 (TW) ..... 93216678 U

(51) Int. Cl.
*E05B 37/02* (2006.01)

(52) U.S. Cl. ..... 70/21; 70/29; 70/30; 70/46; 70/49; 70/284; 70/285

(58) Field of Classification Search ..... 70/38 R, 70/38 B, 25, 38 C, 30, 49, 21, 29, 45–47, 70/284, 285, DIG. 71
See application file for complete search history.

(56) References Cited

U.S. PATENT DOCUMENTS 1,117,417 A * 11/1914 Meepos ..... 70/29
1,300,983 A * 4/1919 Luckey ..... 70/437
1,316,037 A * 9/1919 Hewitt ..... 70/29
RE29,277 E * 6/1977 Harrington et al. ..... 70/25
4,325,240 A * 4/1982 Gable ..... 70/284
5,134,869 A * 8/1992 Gable ..... 70/63
5,359,867 A * 11/1994 Ling et al. ..... 70/28
5,560,232 A * 10/1996 Chen ..... 70/30
5,782,113 A * 7/1998 Chen ..... 70/28
5,901,587 A * 5/1999 Chen ..... 70/28
6,082,155 A * 7/2000 Su ..... 70/22
6,363,758 B1 * 4/2002 Ling ..... 70/30
6,381,997 B1 * 5/2002 Chen ..... 70/28
6,470,718 B1 * 10/2002 Yang ..... 70/30
6,539,761 B1 * 4/2003 Yang ..... 70/284
6,708,534 B1 * 3/2004 Ruan ..... 70/38 A
6,792,778 B1 * 9/2004 Chen ..... 70/21
6,928,842 B1 * 8/2005 Huang ..... 70/21
2002/0073747 A1 * 6/2002 Chen ..... 70/49
2002/0088256 A1 * 7/2002 Taylor et al. ..... 70/25
2002/0194887 A1 * 12/2002 Chang ..... 70/38 B
2003/0000264 A1 * 1/2003 Yang ..... 70/25

* cited by examiner

*Primary Examiner*—Lloyd A. Gall
(74) *Attorney, Agent, or Firm*—Pro-Techtor Int'l Services

(57) ABSTRACT

Provided is a combined combination lock and padlock comprising a second shackle receiving hole including an inside slot at one leg of a shackle of steel rope for receiving a spring depressible block, a tumbler wheel assembly, a key turning assembly, a pivot assembly, a push button, and a U-shaped shackle, A correct combination of tumblers and a subsequent pressing of the push button will disengage a dog with the slot and thus expansion of the block will push the leg out of engagement with the lock. Should either the combination be forgotten or the combination be changed by another person, a turning of the shaft about 90 degrees by inserting a key into the keyhole will turn the projection and the engaged engagement member for releasing the dog.

1 Claim, 5 Drawing Sheets

COMBINED COMBINATION LOCK AND PADLOCK

BACKGROUND OF THE INVENTION

1. Field of Invention

The present invention relates to combination locks and more particularly to a combination lock capable of being opened by inserting a key into keyhole in addition to turning tumbler wheels to a set series of numbers for opening.

2. Related Art

Combination locks and padlocks are two different types of lock and a great difference with respect to construction thus exists between them. Also, disclosures about combined combination lock and padlock were not available several years ago as far as the present invention is aware.

U.S. Pat. No. 6,792,778 to Chen, entitled "Combination Lock" is specifically incorporated herein by reference. This patent is assigned to Glox Industry Co., Ltd., assignee of the subject invention. Shackle disclosed in this patent is not the same as one disclosed in the invention as explained later. Moreover, associated construction of the shackle must be redesigned in order to facilitate opening or locking of the lock. The invention is thus addressed to provide a solution to the above.

SUMMARY OF THE INVENTION

It is therefore an object of the present invention to provide a combination lock, comprising a spring depressible block; a housing including a cover having a plurality of first openings, a plurality of parallel, spaced seats each having a substantially half circular recess thereon, an elongate trough adjacent the seats, a T-shaped first shackle receiving hole at a top surface, a cavity at one side in communication with both the trough and the seats, a second shackle receiving hole at the top surface in spaced, parallel aligned relationship with the first shackle receiving hole, the second shackle receiving hole including an inside slot for receiving the block, and a through hole on its wall, a pin adjacent the trough, a receptacle between the seats and the trough and adjacent the pin, and a second opening in communication with both the cavity and the outside; a tumbler wheel assembly supported on the recesses and including a plurality of tumbler wheels each having a series of numbers in which at least one is exposed on the corresponding first opening, a plurality of inner, hollow cylinders each fitted in the tumbler wheel, and a spring depressible bar engaged the cylinder and including a plurality of sets of projections disposed axially along its surface and a flat head at one end adjacent the second opening; a key turning assembly disposed in the trough and including a keyhole and a rotatable shaft having a projection of half circular section protruded from an inner end thereof toward the cavity; a pivot assembly provided in the cavity and including an aperture pivotably put on the pin, a latch extended toward the second shackle receiving hole, the latch including a locking dog at an open end, an engagement member having a rounded end engaged the flat of the projection in a locked position, a base disposed on the second opening, a protrusion projected downward from the base, a protuberance extended in a direction perpendicular to that of the protrusion, and a resilient member compressed between the protuberance and the receptacle; a push button including a nose at an inner side to urge against the head, an arm disposed on the base, the arm being urged outward by the protrusion for closing the second opening in the locked position, and a bore at one end snugly put on the aperture for enabling the push button and the pivot assembly together to pivot about the pin; and a U-shaped shackle including a first annular groove proximate a first terminating end at one leg, the groove being retained in the first shackle receiving hole, a second annular groove proximate a second terminating end of the other leg, and an enlargement proximate the second groove engaged the dog in the locked position with the enlargement disposed on top surface of the housing and the block compressed, whereby a correct combination of the tumbler wheels will unlock the bar, and a pressing of the push button will push the head and further push the head toward the cylinder, thereby pivoting both the push button and the pivot assembly about the pin, compressing the resilient member, disengaging the dog with the second groove, and exerting an elastic force of the energized block on the other leg for pushing the other leg out of the second shackle receiving hole for unlocking the lock; or a turning of the shaft about 90 degrees by inserting a key into the keyhole will change the flat of the projection engaged the engagement member in a first position to the sharp edge of the projection engaged the engagement member in a second position for pushing the engagement member to pivot the pivot assembly, disengage the dog with the second groove, and exert the elastic force of the energized block on the other leg for pushing the other leg out of the second shackle receiving hole for unlocking the lock.

The above and other objects, features and advantages of the present invention will become apparent from the following detailed description taken with the accompanying drawings.

DETAILED DESCRIPTION OF THE INVENTION

Figure 1:
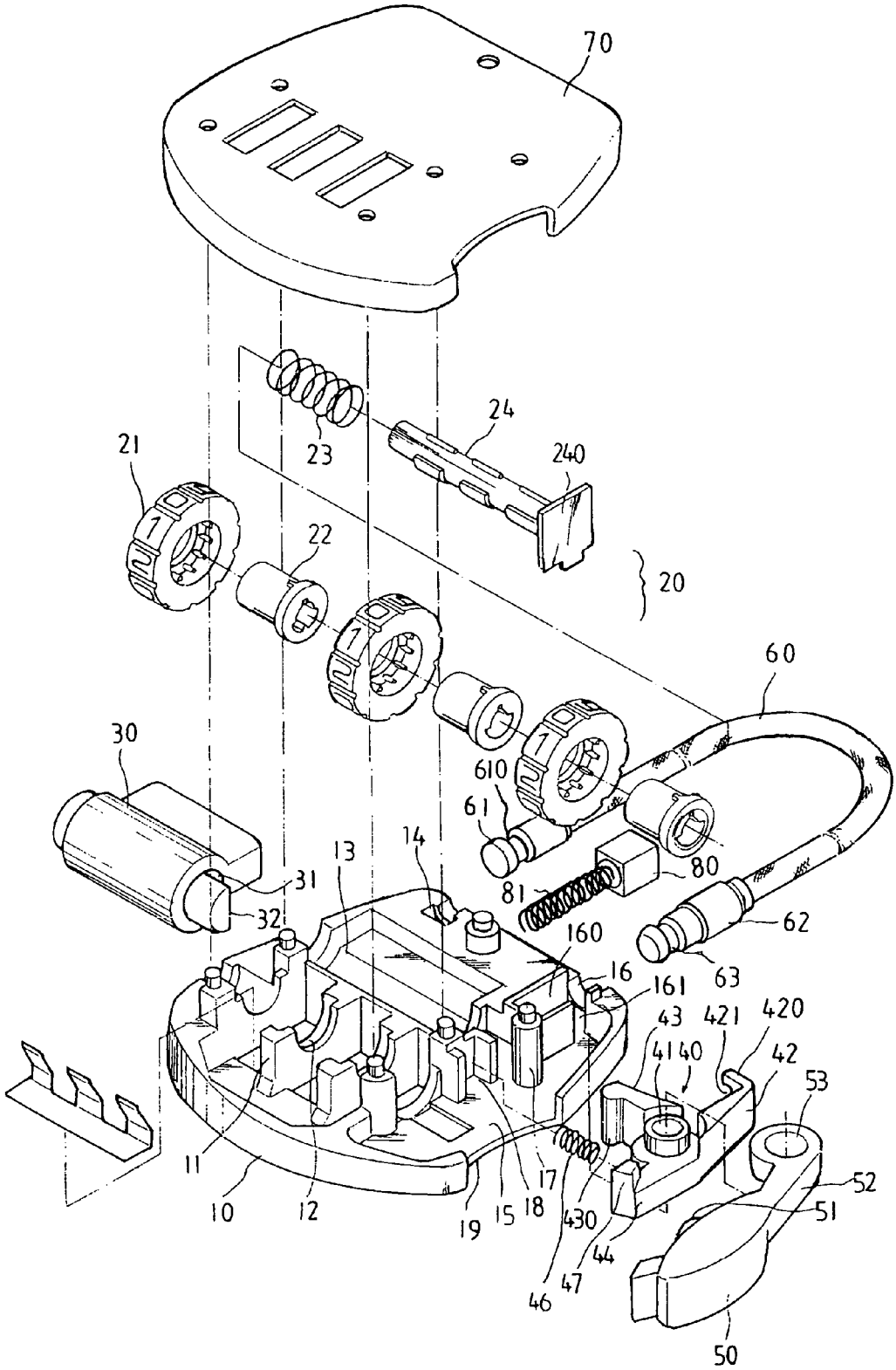
FIG. 1 is an exploded view of a preferred embodiment of combined combination lock and padlock according to the invention.

Referring to FIGS. 1 to 6, a combined combination lock and padlock (i.e., lock) constructed in accordance with the invention is shown and comprises a housing 10, a tumbler wheel assembly 20, a key turning assembly 30, a pivot assembly 40, a push button 50, a U-shaped shackle 60, and a spring depressible block 80 having a spring 81.

The substantially parallelepiped housing 10 comprises a cover 70 fastened thereon by snapping or screws known to those skilled in the art. The cover 70 comprises three rectangular openings (not numbered). The housing 10 further comprises a base including three parallel, spaced seats 11 each having a substantially half circular recess 12 thereon, an elongate groove 13 adjacent the seats 11, a T-shaped first shackle receiving hole 14 at a top surface, a cavity 15 at one side in communication with both the groove 13 and the seats 11, a second shackle receiving hole 16 at the top surface in spaced, parallel aligned relationship with the first shackle receiving hole 14, the second shackle receiving hole 16 including an inside slot 160 for receiving the block 80, and a through hole 161 on its wall, a pin 17 adjacent the groove 13, a receptacle 18 between the seats 11 and the groove 13 and adjacent the pin 17, and an opening 19 in communication with both the cavity 15 and the outside.

Figure 2:
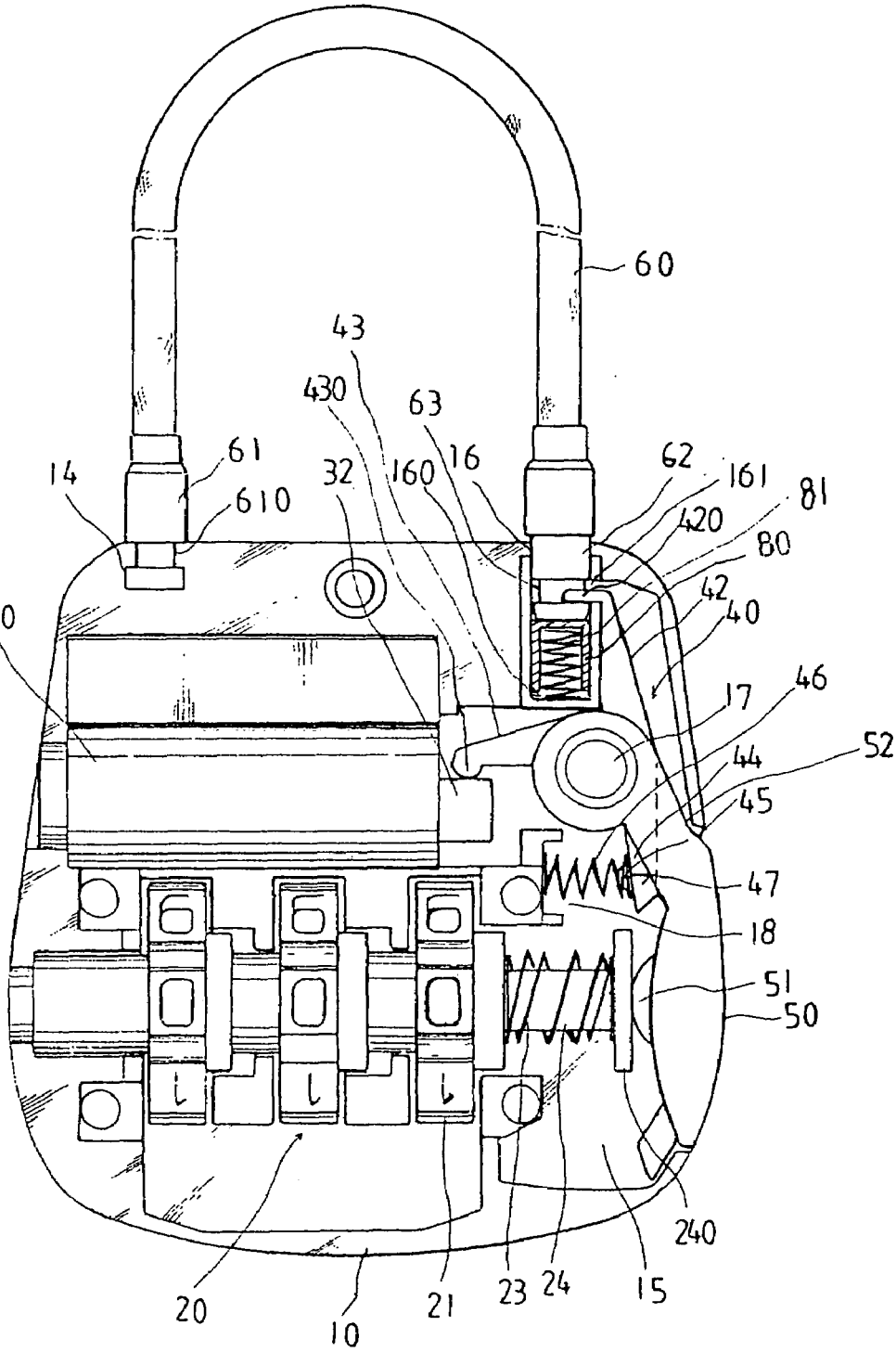
FIG. 2 is a sectional view of the assembled combined combination lock and padlock shown in FIG. 1 where the lock is locked.
Figure 3:
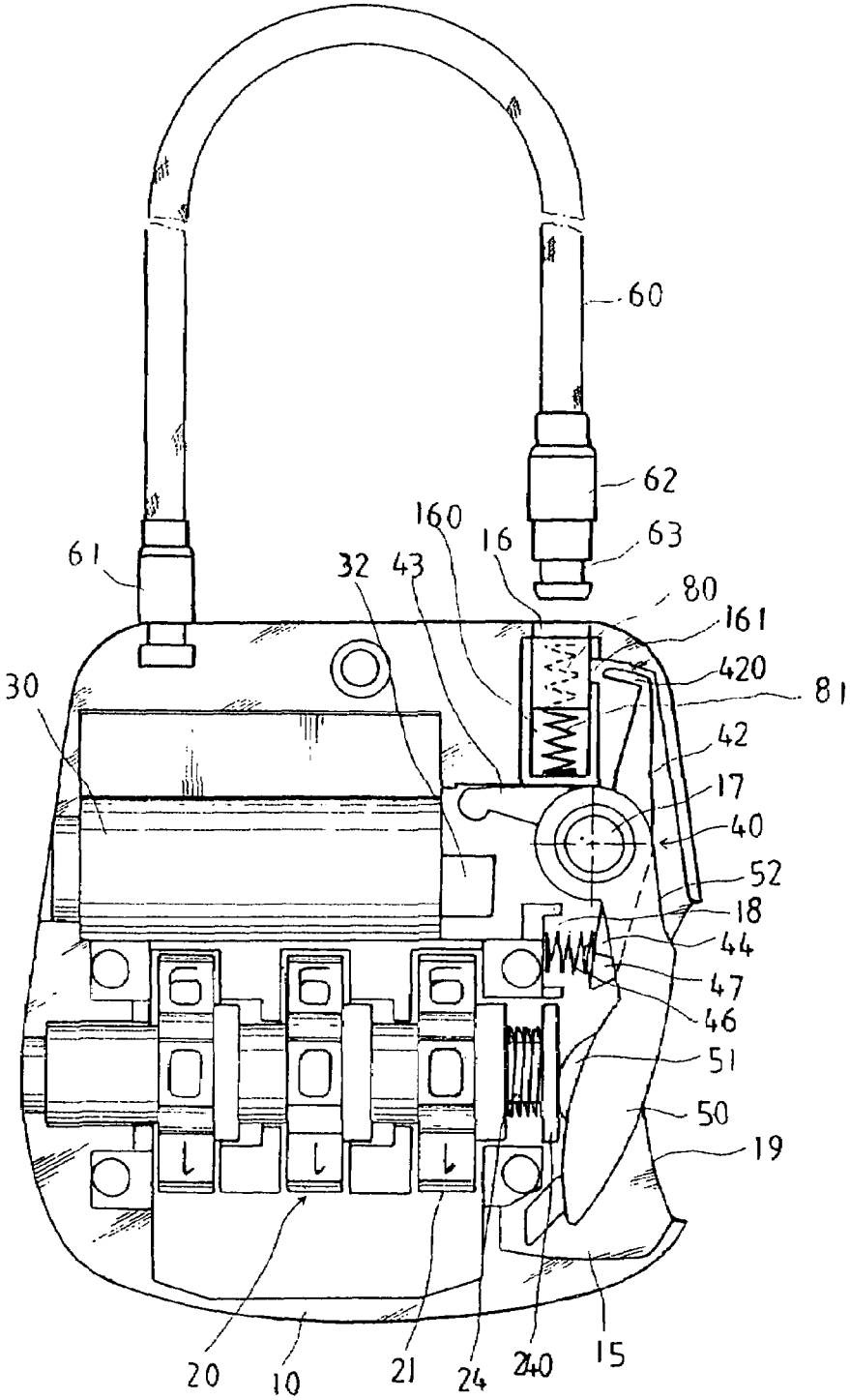
FIG. 3 is a view similar to FIG. 2, where the lock is unlocked in response to turning tumbler wheels to a set series of numbers.
Figure 4:
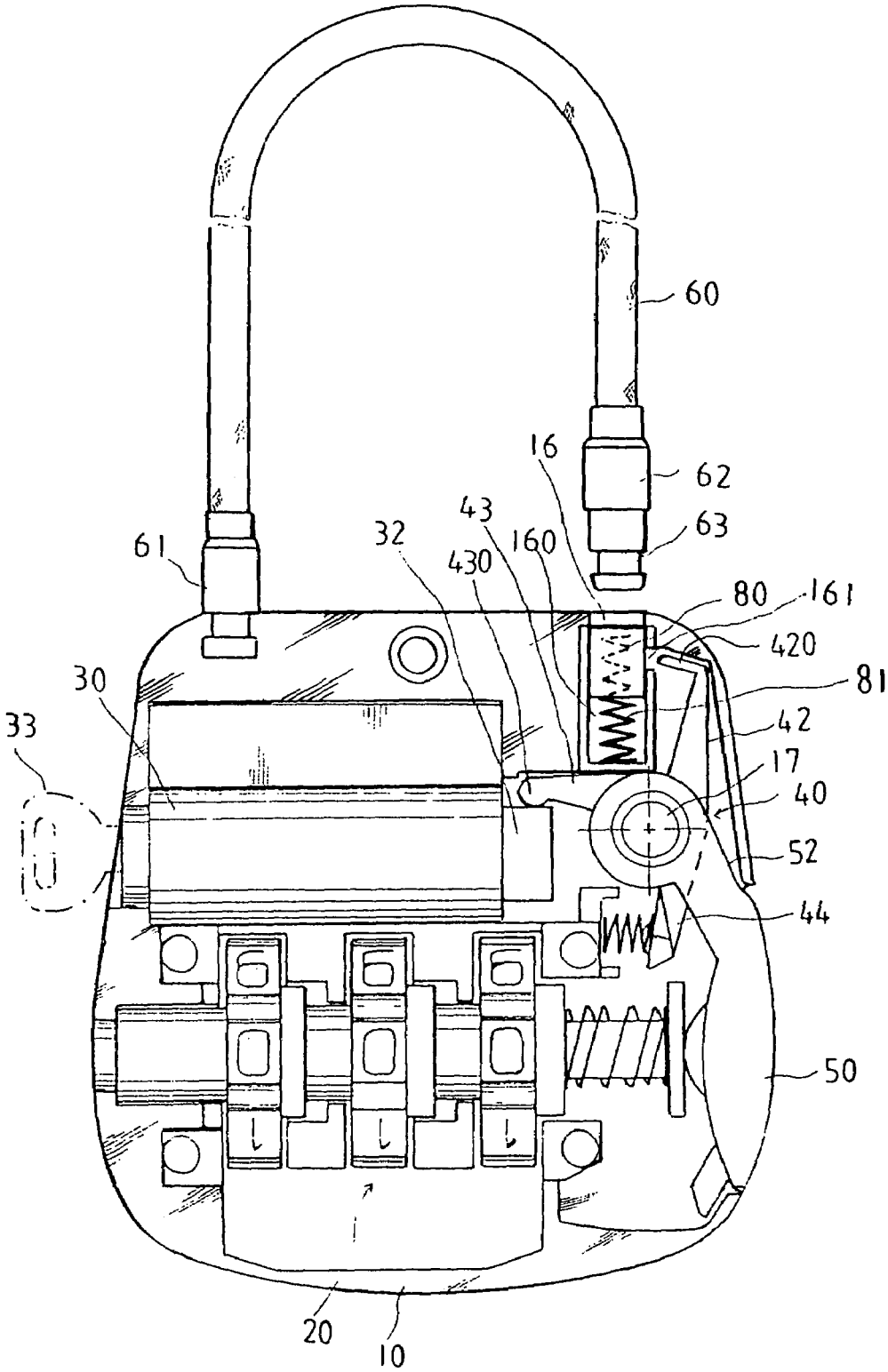
FIG. 4 is a view similar to FIG. 3, where a key is inserted into a keyhole when the combination has been forgotten or the combination has been changed by another person who shares the ownership thereof.
Figure 5:
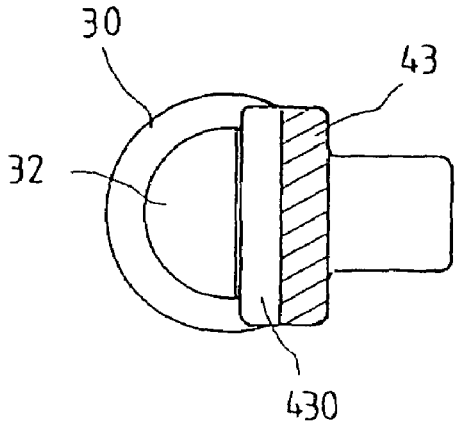
FIGS. 5 and 6 are side views in part section showing engagements of projection and rounded end of engagement member prior to turning the projection and after the turning respectively.
Figure 6:
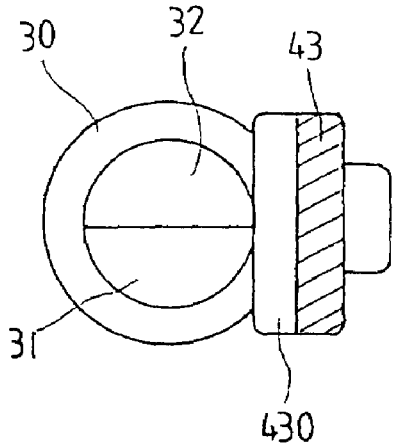

The tumbler wheel assembly 20 is supported on the recesses 12 and comprises three tumbler wheels 21 each having a series of numbers in which at least one is exposed on the corresponding opening of the cover 70, three inner, hollow cylinders 22 each fitted in the tumbler wheel 21, a bar 24 having a plurality of sets of projections disposed axially along its surface and a flat head 240 at one end adjacent the opening 19, a coil spring 23 put on the shank of the bar 24 being compressed between the head 240 and the rightmost cylinder 22 (see FIG. 2).

The key turning assembly 30 is disposed in the groove 13 and comprises a keyhole (not shown) and a rotatable shaft 31 having a projection 32 of half circular section protruded from an inner end thereof toward the cavity 15.

The pivot assembly 40 is provided in the cavity 15 and comprises a hole 41 pivotably put on the pin 17, a latch 42 extended toward the second shackle receiving hole 16, the latch 42 including a locking dog 420 at an open end and an arcuate slope 421 on the dog 420, an engagement member 43 having a rounded end 430 engaged the flat of the projection 32 in a locked position (see FIG. 2), a base 44 disposed on the opening 19, a protrusion 47 projected downward from the base 44, a protuberance 45 extended in a direction perpendicular to that of the protrusion 47, and a coil spring 46 compressed between the protuberance 45 and the receptacle 18.

The push button 50 comprises a nose 51 at an inner side to urge against the head 240, an arm 52 disposed on the base 44, the arm 52 being urged outward by the protrusion 47 for closing the opening 19 in the locked position, and a bore 53 at one end snugly put on the upper, annular flange around the hole 41 for enabling the push button 50 and the pivot assembly 40 together to pivot about the pin 17.

The shackle 60 is implemented as a steel rope in its most portions and comprises a first terminating end 61 at one leg, and a first annular groove 610 proximate the first terminating end 61 in which both the first terminating end 61 and the groove 610 are retained in the first shackle receiving hole 14. The shackle 60 further comprises a second annular groove 63 proximate a second terminating end of the other leg, and an enlargement 62 proximate the second groove 63. The second groove 63 engages the dog 420 in the locked position with the enlargement 62 disposed on top surface of the housing 10 and the spring 81 of the block 80 compressed (see FIG. 2).

An unlocking operation of the invention will now be described in detail below. In a normal case a person can turn the tumbler wheels 21 until the correct set series of numbers (i.e., combination) are shown on the openings of the cover 70. At this moment, the locking of the bar 24 by the cylinders 22 is unlocked. Next, the person can press the push button 50 to push the head 240 and further compress the spring 23, thereby pivoting both the push button 50 and the pivot assembly 40 about the pin 17, compressing the spring 46, and disengaging the dog 420 from the second groove 63. At the same time, the energized block 80 expands to exert its elastic force to push the other leg out of the second shackle receiving hole 16 for unlocking the lock. The shackle 60 thus is able to pivot about the first shackle receiving hole 14.

An operation of enabling a person to open the lock either should the combination be forgotten or the combination has been changed by another person who shares the ownership of the lock will now be described in detail below. A person can insert a key 33 into the keyhole to turn the shaft 31 about 90 degrees from the position of the flat of the projection 32 engaged the rounded end 430 (see FIG. 5) to the position of the sharp edge of the projection 32 engaged the rounded end 430 (see FIG. 6). At the same time, the engagement member 43 is pushed to pivot the pivot assembly 40. As a result, the dog 420 is disengaged with the second groove 63 and the combination lock is unlocked.

While the invention herein disclosed has been described by means of specific embodiments, numerous modifications and variations could be made thereto by those skilled in the art without departing from the scope and spirit of the invention set forth in the claims.

What is claimed is:

1. A combination lock, comprising:

a spring depressible block;

a housing including a cover having a plurality of first openings, a plurality of parallel, spaced seats each having a substantially half circular recess thereon, an elongate trough adjacent the seats, a T-shaped first shackle receiving hole at a top surface, a cavity at one side in communication with both the trough and the seats, a second shackle receiving hole at the top surface in spaced, parallel aligned relationship with the first shackle receiving hole, the second shackle receiving hole including an inside slot for receiving the block, and a through hole on its wall, a pin adjacent the trough, a receptacle between the seats and the trough and adjacent the pin, and a second opening in communication with both the cavity and the outside;

a tumbler wheel assembly supported on the recesses and including a plurality of tumbler wheels each having a series of numbers in which at least one is exposed on the corresponding first opening, a plurality of inner, hollow cylinders each fitted in the tumbler wheel, and a spring depressible bar engaged the cylinders and including a plurality of sets of projections disposed axially along its surface and a flat head at one end adjacent the second opening;

a key turning assembly disposed in the trough and including a keyhole and a rotatable shaft having a projection of half circular section protruded from an inner end thereof toward the cavity;

a pivot assembly provided in the cavity and including an aperture pivotably put on the pin, a latch extended toward the second shackle receiving hole, the latch including a locking dog at an open end, an engagement member having a rounded end engaged with the flat of the projection in a locked position, a base disposed in the second opening, a protrusion projected downward from the base, a protuberance extended in a direction perpendicular to that of the protrusion, and a resilient member compressed between the protuberance and the receptacle;

a push button including a nose at an inner side to urge against the head, an arm disposed on the base, the arm being urged outward by the protrusion for closing the second opening in the locked position, and a bore at one end snugly put on the aperture for enabling the push button and the pivot assembly together to pivot about the pin; and a U-shaped shackle including a first annular groove proximate a first terminating end at one leg, the groove being retained in the first shackle receiving hole, a second annular groove proximate a second terminating end of the other leg, and an enlargement proximate the second groove which is engaged with the dog in the locked position with the enlargement disposed on the top surface of the housing and the block compressed, whereby a correct combination of the tumbler wheels will unlock the bar, and a pressing of the push button will push the head and further push the head toward the cylinders, thereby allowing pivoting both the push button and the pivot assembly about the pin, compressing the resilient member, disengaging the dog from the second groove, and exerting an elastic force of the energized block on the other leg for pushing the other leg out of the second shackle receiving hole for unlocking the lock; or a turning of the shaft about 90 degrees by inserting a key into the keyhole will change the flat of the projection engaged with the engagement member in a first position to the sharp edge of the projection engaged with the engagement member in a second position for pushing the engagement member to pivot the pivot assembly, disengage the dog from the second groove, and exert the elastic force of the energized block on the other leg for pushing the other leg out of the second shackle receiving hole for unlocking the lock.

* * * * *